United States Patent [19]

Perry et al.

[11] 3,934,383

[45] Jan. 27, 1976

[54] ROOF VENT

[76] Inventors: Loren L. Perry, Rte. 1, Alani Court, Winston Salem, N.C. 27013; Louis J. Tuglus, 3419 N. Pontiac, Chicago, Ill. 60634

[22] Filed: July 15, 1974

[21] Appl. No.: 488,505

Related U.S. Application Data

[63] Continuation of Ser. No. 377,606, July 9, 1973, abandoned.

[52] U.S. Cl. ..... 52/200; 49/342; 49/405; 52/199; 98/2.14; 98/37

[51] Int. Cl.[2] ..... E04B 7/18

[58] Field of Search ..... 52/198, 199, 200, 212; 49/342, 405; 98/37, 2.14, 13

[56] References Cited

UNITED STATES PATENTS

| | | | |
|---|---|---|---|
| 1,480,274 | 1/1924 | Barre | 98/2.14 |
| 2,211,367 | 8/1940 | Davey et al. | 98/13 |
| 2,328,659 | 9/1943 | McKenna | 98/13 X |
| 2,372,164 | 3/1945 | Woodhams | 49/342 X |
| 2,517,303 | 8/1950 | Green | 98/2.14 |
| 2,718,187 | 9/1955 | Frisby | 98/37 |
| 3,018,524 | 1/1962 | Schlegel | 52/212 X |
| 3,112,687 | 12/1963 | Henneberger | 98/13 X |
| 3,220,079 | 11/1965 | Aggson | 98/37 X |
| 3,665,661 | 5/1972 | Beckerer | 52/200 X |
| 3,742,659 | 7/1973 | Drew | 52/199 X |

FOREIGN PATENTS OR APPLICATIONS

| | | | |
|---|---|---|---|
| 258,800 | 6/1928 | Italy | 52/199 |
| 641,725 | 4/1964 | Belgium | 52/200 |
| 629,516 | 7/1963 | Belgium | 52/200 |

OTHER PUBLICATIONS

R. V. Dealer, p. 111, June, 1972, TL297/R4, "Elixir Industries."

R. V. Dealer, Dec. 1972, TL297/R4, p. 1, "Elixir Industries."

R. V. Dealer, Feb. 1973, TL297/R4, p. 88, "Strawsine."

R. V. Dealer, July 1968, TL297/R4, p. 69, "Triangle Products."

R. V. Dealer, July 1968, TL297/R4, p. 24, "Strawsine."

*Primary Examiner*—Frank L. Abbott
*Assistant Examiner*—Leslie A. Braun

[57] ABSTRACT

There is provided an improved operating roof vent of plastic such as translucent resin for mounting in a vent opening of a roof. An inner one piece combination screen and garnish member telescopically mates with an outer one piece cowl member. A combination one piece cover and hinge closes the cowl member, with the hinge being secured to the cowl member to provide for swinging opening and closing of the cover.

3 Claims, 6 Drawing Figures

ROOF VENT

This is a continuation of application Ser. No. 377,606 filed July 9, 1973.

The present invention relates to a new and improved operating roof vent and particularly to an operating roof vent useful for mounting in a vent opening of a motor home, camper, and the like.

Heretofore, roof vents have customarily been fabricated of metal, with perhaps a translucent cover. Such prior construction has had certain disadvantages. The roof vents are exposed to the weather, and metal vent and vent frames are subject to rusting and deterioration by the weather. Moreover, rubbing of the metal parts causes rattling and looseness of the vent members. Typically, a separate bug screen must be used.

Accordingly, it is an object of the present invention to provide a new and improved operating roof vent which overcomes the above mentioned difficulties.

Yet another object of the present invention is the provision of a new and improved roof vent particularly useful for campers, motor homes, and the like.

Still another object of the present invention is the provision of a new and improved operating roof vent.

For a better understanding of the present invention, reference may be had to the following detailed description when taken in conjunction with the drawings, in which.

Figure 1:
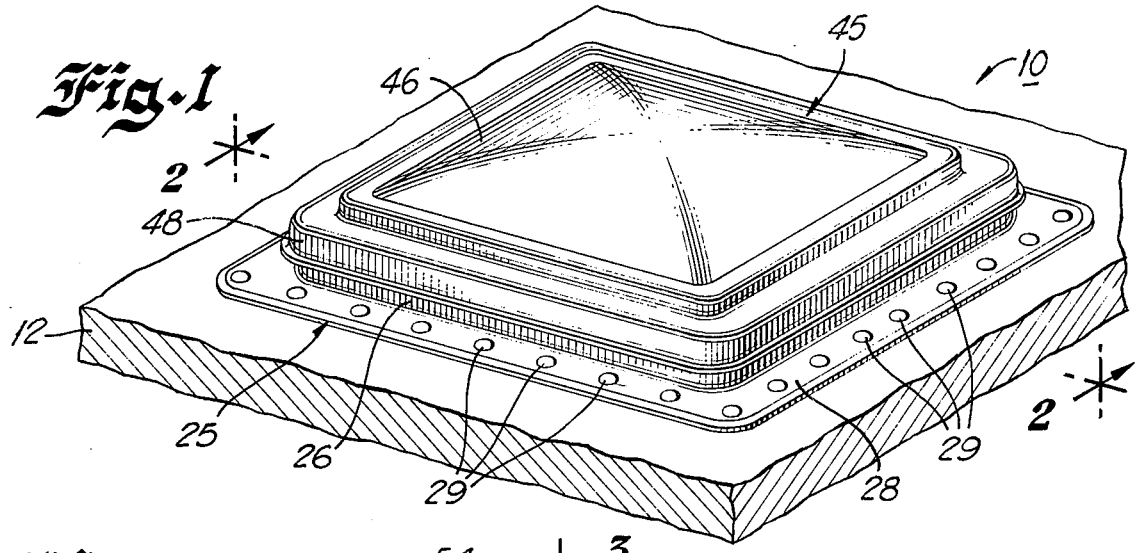
FIG. 1 is a top perspective view of the improved roof vent according to the present invention.

Briefly, the foregoing and other objects of the present invention are accomplished by the provision of a new and improved operating roof vent of plastic such as of translucent resin for mounting in a vent opening of a roof such as on a camper or motor home. The improved roof vent is formed of three pieces, an inner one piece screen and garnish member, an outer one piece cowl member operatively associated in mating relation with the inner screen and garnish member, and a combination one-piece cover and hinge, the hinge being secured in any suitable manner to the cowl member.

In a particular embodiment of the invention, the screen and garnish member and the outer cowl member are telescopically associated to provide for variations in the roof thickness. The screen and garnish member and the cowl member are each provided with outwardly extending peripheral flange portions adapted for securement to the peripheral edges of a vent opening. Advantageously, the peripherally extending flange portions of the cowl member may be provided with ribs or grooves forming a corrugated or gripping surface for mounting putty. Deck means may be provided adjacent the upper ends of the cowl member for receiving suitable weathering and advantageously a full seal may be provided all around the joint between the cowl and cover.

Advantageously, the roof vent according to the present invention, being formed of a plastic, preferably of translucent resin, is rust proof, and avoids rattles. The simple three piece design minimizes inventory and handling and assembling of components. Advantageously, the screen and garnish combination provides secure bug protection. The hinge member, fixed to the cover, and secured to the cowl in any suitable manner as by an ultrasonic weld, minimizes cost and maintenance and provides a durable joint. Thus, there is provided an operating roof vent low in design, light in weight, and inexpensive and easy to manufacture and install.

Refering now to the drawings, there is illustrated a new and improved operating roof vent 10 installed in a vent opening 11 of a roof, fragmentarily illustrated at 12, of a camper, motor home, or other desired structure. The roof vent 10 is formed of plastic, such as a clear or translucent resin. One satisfactory material is an integrally molded material known as "ABS" plastic resin (acrylonitrile-butadiene-styrene), which is high in mechanical strength and relatively inert to the weather. In addition to "ABS" plastic resin, the roof vent 10 may also be molded out of other resins such as polypropylene, cellulose acetate butyrate, acrylic resin, or vinyl resin (polyvinyl chloride acetate) or other suitable materials.

The roof 10 includes an inner one piece screen and garnish member 15 including an inner frame portion 16 defining a ventilating opening 17. A screen or screen portion 18 is integrally molded, as by injection molding, with the remainder of the screen and garnish member across the ventilating opening. A lower peripherally extending flange portion 19 is provided for securement to the inner peripheral edges of the vent opening 11 by means of fasteners 20 such as screws or nails.

Figure 2:
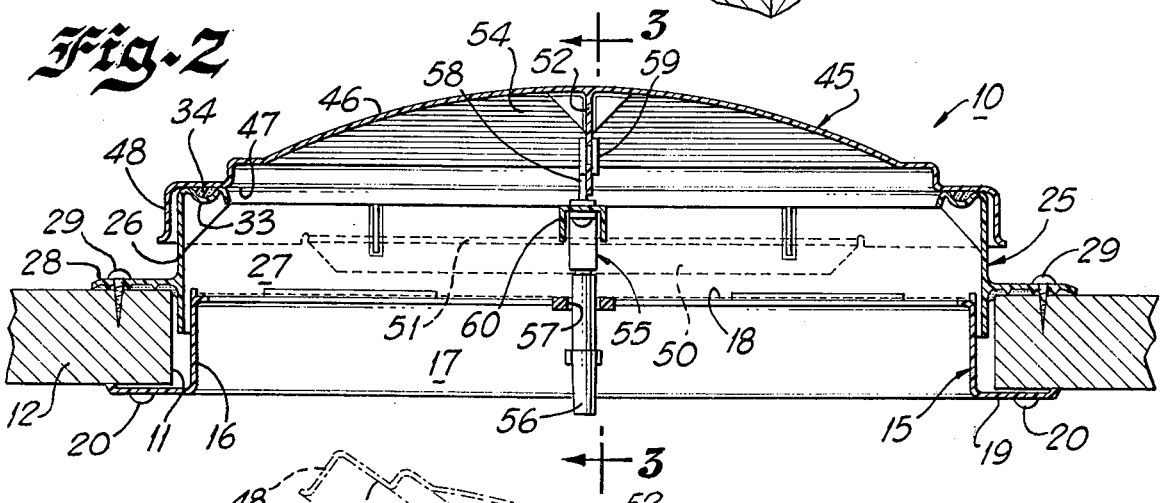
FIG. 2 is a cross sectional elevational view of the roof vent of FIG. 1, taken along line 2—2 of FIG. 1.
Figure 6:
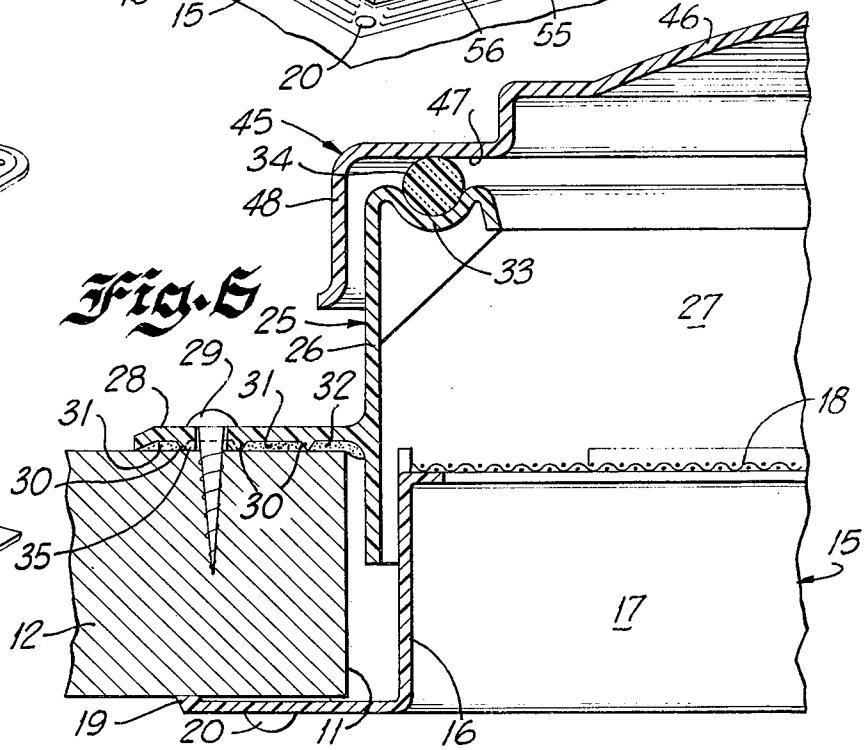
FIG. 6 is an enlarged detail view of the roof vent of FIG. 1.
Figure 5:
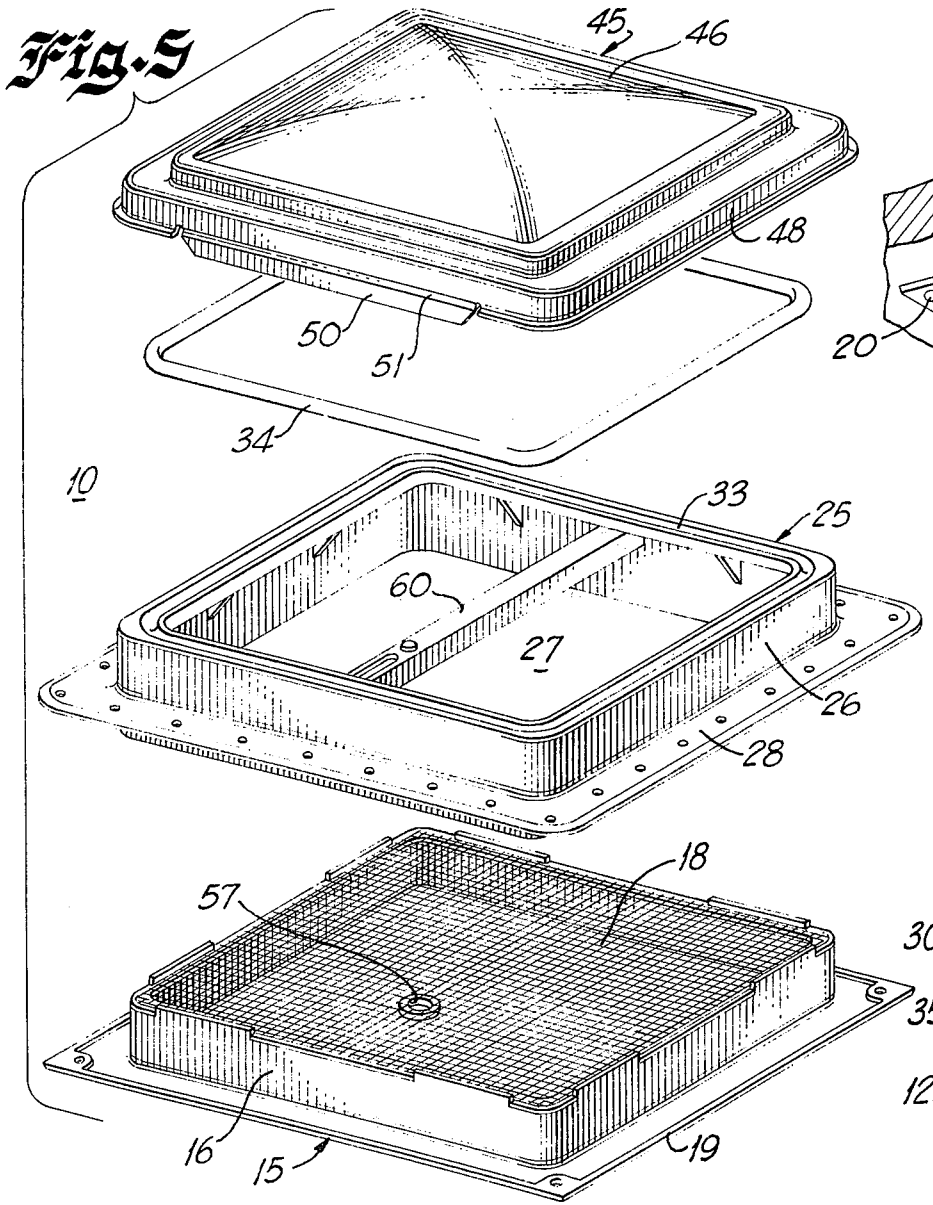
FIG. 5 is an exploded perspective view of the roof vent of FIG. 1.

The roof vent 10 additionally includes an outer one piece cowl member 25 including an outer frame portion 26 defining a ventilating opening 27. An intermediate peripherally extending flange portion 28 is adapted for securement to the outer peripheral edges of the vent opening 11 by means of suitable fasteners 29 such as screws or nails. As best illustrated in FIG. 6, the lower surface of the flange portion 28 is provided with ribs 30 defining grooves 31 forming a basis for mounting putty 32 providing a water tight connection between the cowl member 25 and the roof 12. A base 35 provides for seating of the screws 29 while preventing distortion of the flange portion 28. A deck 33 is provided at the upper inner edge of the frame portion 26 for receiving a sealing gasket 34 here shown as of circular cross section before compression upon fully closing. As best illustrated in FIGS. 2, 3 and 6, the frame portions of the screen and garnish member 15 and of the cowl member 25 are telescopically associated so as to provide for adjustable mounting on roofs of varying thickness.

The roof vent 10 additionally includes an integrally formed one piece cover and hinge member 45 including an outwardly dished cover portion 46. The cover portion 46 is provided with a sealing surface 47, FIG. 6, for mating with the sealing gasket 34 and further includes a downwardly extending flange portion 48 telescopically closable over the outer frame portion 26 of the cowl member 25. A hinge portion 50, FIGS. 3 and 4, is integrally formed or molded with the remainder of the cover and hinge member 45 and comprises a suitable flap extending from the lower peripheral edge of a flange portion 48. The connection between the hinge portion 50 and the cover portion 46 includes a reduced neck portion 51, here shown in the form of a V-groove, to provide ready flexing between the cover portion and the hinge portion. The cover and hinge member 45 additionally includes internally thereof an integrally formed control rib 52, best illustrated in FIG. 3, and including a control slot 53 of somewhat keyhole shape. Other stiffening ribs, such as rib 54, may be provided for strengthening and stiffening of the cover portion.

Figure 3:
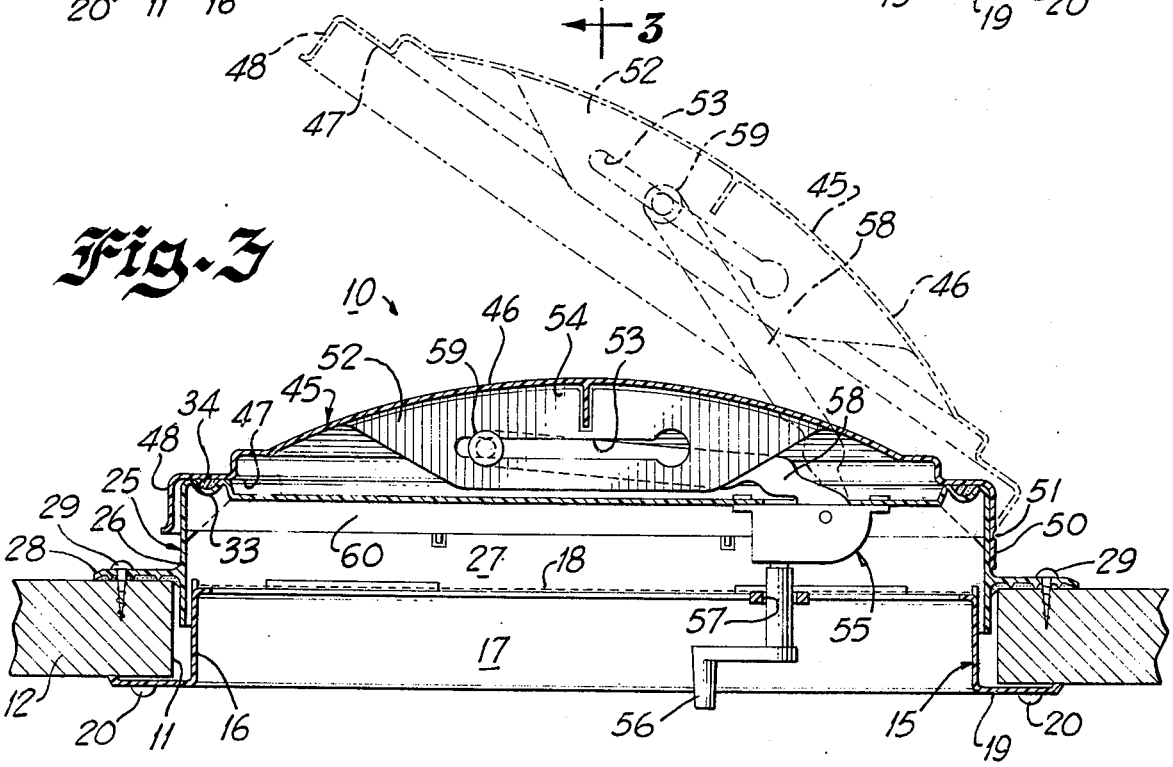
FIG. 3 is a cross sectional elevational view of the roof vent of FIG. 1, taken along line 3—3 of FIG. 2.
Figure 4:
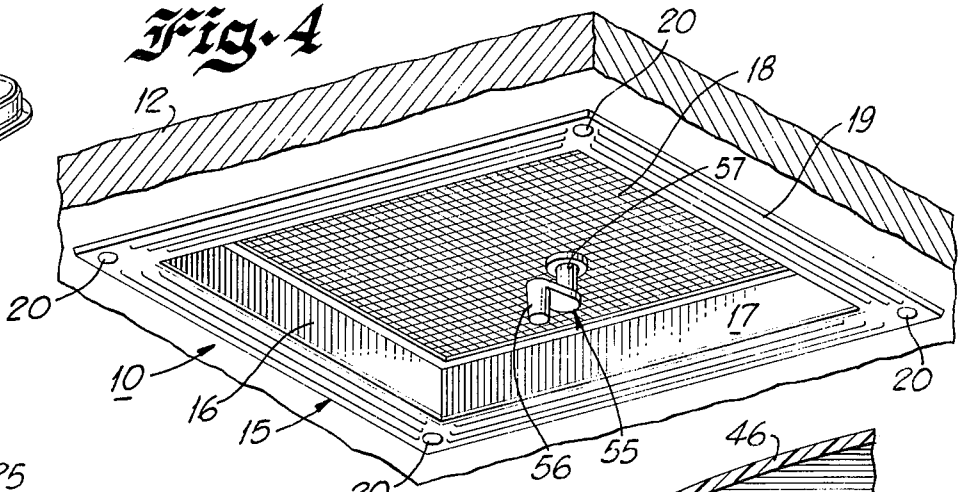
FIG. 4 is a bottom perspective view of the roof vent of FIG. 1.

A suitable vent operator 55 is provided including a control handle 56 extending through an opening 57 in the screen 18 and additionally including a control rod 58, best illustrated in FIG. 3. The control rod carries a locking ring 59 adjacent its end to provide a neck portion engageable within the control slot 53. To provide for mounting of the vent operator 55, the cowl member 25 includes an integrally molded transverse beam providing for support of the vent operator 55. The vent operator 55 is actuable to move the cover portion 46 of the cover and hinge member 45 from the closed position illustrated in solid in FIG. 3 to the open position illustrated in phantom in FIG. 3.

While there has been shown and described a single embodiment of the present invention, it will be apparent to those skilled in the art that various changes and modifications may be made without departing from the spirit and scope of the invention and it is therefore intended in the appended claims to cover all such changes and modifications as fall within the true spirit and scope of the present invention.

What is claimed as new and desired to be secured by Letters Patent of the United States is:

1. An operating roof vent of translucent resin for mounting in a vent opening of a roof comprising; an integral cowl member including a downwardly projecting flange for cooperative insertion into said roof vent opening, an intermediate flange perimetrically surrounding said cowl member for securement to said roof adjacent the roof vent opening, and a vertically projecting outer frame portion of said cowl member extending above said perimetrical flange, a transverse beam integrally molded to said vertically projecting outer frame portion, a unitary vent cover and hinge member, said vent cover having a dished head and a perimetrical rim for cooperatively receiving said vertically projecting outer frame portion of said cowl member, said hinge member projecting from said outer rim downwardly, said hinge member being bonded to one section of said vertically projecting outer frame portion for pivotally supporting said vent cover, said vent cover having a depending control rim integrally formed in said dished vent cover in spaced juxtaposition and in alignment with said transverse beam, and means mounted on said transverse beam and connected to said depending control rib through an elongated slot in said rib for controlling the pivoting of said vent cover between closed, open and intermediate positions, said vertically projecting outer frame portion having a sealing deck, said sealing deck having a gasket receiving recess, a sealing gasket secured to said sealing deck for cooperatively sealing engagement with said vent cover in the vent cover close position.

2. An operating roof vent for mounted in a vent opening of a roof as claimed in claim 1, said intermediate perimetrical flange having spaced-apart openings therein.

3. An operating roof vent for mounting in a vent opening of a roof as claimed in claim 1, and an inner unitary frame having a screen attached thereto cooperatively receivable in said cowl member, said frame having a protruding flange for fastening to a ceiling beneath the vent opening.

* * * * *